United States Patent [19]

Price

[11] 3,997,025

[45] Dec. 14, 1976

[54] ACCESS DOOR AND LADDER STRUCTURE FOR SILO

[75] Inventor: Raymond R. Price, Rochester, Minn.

[73] Assignee: Rochester Silo, Inc., Rochester, Minn.

[22] Filed: Sept. 4, 1975

[21] Appl. No.: 610,453

[52] U.S. Cl. ..... 182/77; 182/91; 49/193; 49/153

[51] Int. Cl.[2] ..... E05D 15/50

[58] Field of Search ..... 182/77, 78, 90, 91, 182/92, 97; 49/153, 193, 485, 484, 495; 52/245, 256, 204

[56] References Cited

UNITED STATES PATENTS

| | | | |
|---|---|---|---|
| 952,876 | 3/1910 | Clark et al. | 52/193 |
| 2,341,763 | 2/1944 | Craine | 52/193 |
| 2,367,720 | 1/1945 | Goldbeck | 52/193 |
| 2,931,599 | 4/1960 | McQuilkin | 49/37 |
| 3,238,679 | 3/1966 | Capoccia | 52/254 |

*Primary Examiner*—Reinaldo P. Machado
*Attorney, Agent, or Firm*—Williamson, Bains & Moore

[57] ABSTRACT

A silo door structure having a ladder rung assembly on which the door is supported, the rung assembly including vertical pivot pin extensions received within vertical apertures formed in the top and bottom cross beams of the door frame. The weight of the door and ladder rung assembly is transmitted to the door frame through the pivot pin extensions as well as through offset, generally horizontal segments on the bottom end of the ladder rung assembly which rests on the bottom sill beam of the door frame when the door is closed.

A locking bar swingably mounted on the door is held in tight engagement with the outside face of the door frame by camming members on a pivotal clamp arm so as to draw the door in tightly against a sealing gasket plastered in place around the periphery of the door frame opening.

16 Claims, 7 Drawing Figures

ACCESS DOOR AND LADDER STRUCTURE FOR SILO

BACKGROUND OF THE INVENTION

Silos utilized for the storage of grains and forage conventionally utilize a plurality of vertically spaced openings in one wall of the silo to permit access to the interior of the silo, as well as for silo unloading purposes. These openings are closed by doors which are either displaceable or movable to open positions. It has also been a common practice to mount ladder rungs on the doors so as to provide a continuous ladder formed by the rungs on vertically adjacent doors. One of the problems associated with prior art silo door structures is that the doors actually support the ladder rung assemblies, with the weight of the doors being supported entirely on hinges affixed to the door frame. See, for example, U.S. Pat. No. 3,709,345. U.S. Pat. Nos. 1,130,307; 1,009,889 and 2,367,720 disclose silo doors pivotally supported on pin members extending into top and bottom cross beams forming a part of a door frame. However, none of the door structures disclosed in this prior art are supported in such a way as to effectively transmit the weight of the door, and the weight of a person stepping on ladder rungs affixed to the door, to the door frame structure. If the hinge connections rust and fail, the entire door assembly is likely to fall under a person's weight acting on ladder rungs attached to the door.

Moreover, known silo door structures are not provided with locking and sealing means capable of tightly closing the door against a door frame in such a way as to preclude the admission of air and moisture. U.S. Pat. No. 1,130,307 discloses a sealing strip around a silo door frame of the type known in the prior art.

The silo door mounting and sealing structure disclosed herein has been developed with a view towards overcoming the aforesaid problems and mounting a silo door on a ladder rung structure in such a way that the weight load of the door and of a person standing in the ladder rungs is transmitted through the ladder rung assembly to the cross beams or sills forming a portion of the door frame. Also, an improved gasketing and door locking arrangement is provided to insure the airtight closing of such a silo door assembly.

BRIEF SUMMARY OF THE INVENTION

The improved silo door structure of this invention is particularly characterized by a door support and locking arrangement which insures that the weight of the door will be supported on the door frame, and that the door may be freely swung between a closed position in which it is tightly locked against a sealing gasket around the door frame opening to an open, completely non-obstructing position with respect to the silo door opening.

These basic objects and advantages are realized by a combination of features, a primary one of which is a ladder rung and door hinge assembly on which the door is mounted, and which is pivotally supported on the door frame in such a way as to effectively transmit the weight load of the door, and of a person standing on the ladder rungs to the cross beams defining the top and bottom sills of the door frame. The ladder rung assembly preferably comprises a pair of laterally spaced, upright bars and a pair of vertically spaced, generally horizontal ladder rungs extending therebetween. A pair of hinge pin extensions on offset bar segments at the top and bottom of one of the upright bars project into vertical apertures provided in the top and bottom sill beams of the door frame and permit the door to be swung between open and closed positions. Advantageously, offset, generally horizontal bar segments on opposite sides of the ladder rung assembly, at the bottom thereof are in contact with the bottom door sill beam when the door is closed, whereby the weight of the door is supported on the bottom sill beam of the door frame.

A further beneficial aspect of my improved silo door assembly resides in the use of the combination of a swingable locking bar and a clamping arm pivotally supported on the door to hold it in tight, sealing engagement with the door frame. The locking bar is swingable to a locking position wherein its opposite ends bear against opposite sides of the front or outside face of the door frame. A clamp arm, preferably pivotally supported in overlying relation to the locking bar, is provided with camming means which bear against the locking bar and urge it tightly against the front face of the door frame when the clamp arm is moved to a locking position in direct, overlying alignment with respect to the locking bar.

Tight sealing of the door around the opening defined by the door frame is provided by a gasket which extends around the periphery of the door frame in overlying engagement with the rear or inside face of the vertical members and sill beams forming the door frame. The strip segments of which the sealing gasket is comprised are advantageously held in place against the inside face of the door frame members by a self-hardening lining material which is applied to the inside wall surface of the silo and door structure on which the door is mounted. Each of the gasket strips includes a longitudinally extending locking shoulder projecting inwardly therefrom which is embeded in the lining material to hold the gasket strips in place. Also, resilient sealing beads extending longitudinally on each of the gasket strips around the entire periphery of the door opening serve as particularly effective sealing devices against which the peripheral edge surface of the door abuts when it is tightly secured in its closed position by the aforesaid locking devices.

These and other objects and advantages of my invention will become readily apparent when the following description is read in conjunction with the accompanying drawings wherein like reference numerals have been used to designate like elements throughout the several views.

DESCRIPTION OF THE PREFERRED EMBODIMENT

Figure 1:
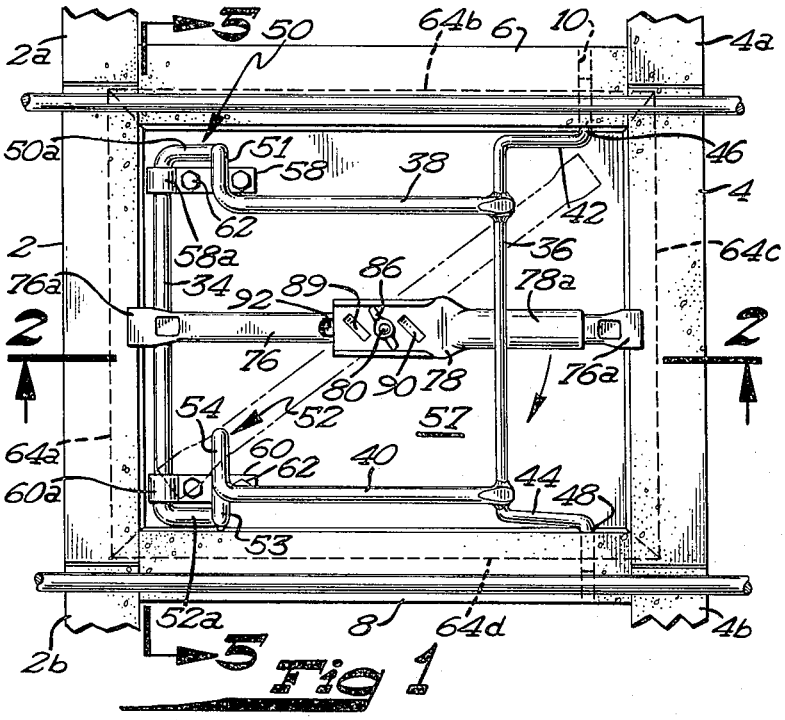
FIG. 1 is a front elevation view of the silo door structure of this invention.
Figure 2:
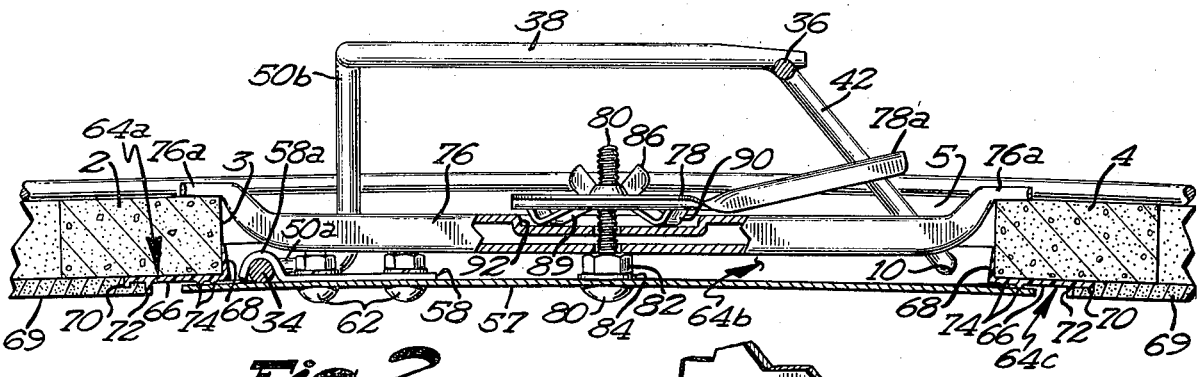
FIG. 2 is a horizontal section view of the silo door structure taken along lines 2—2 of FIG. 1.
Figure 4:
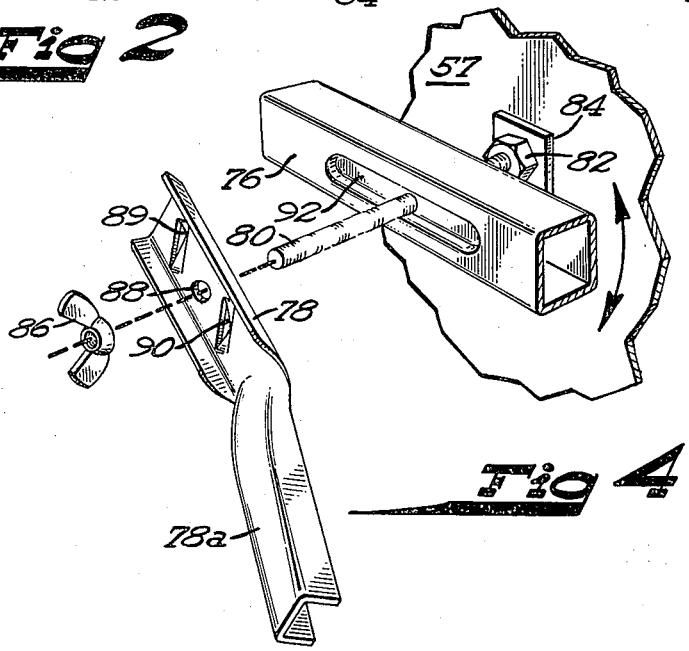
FIG. 4 is a fragmentary, perspective view showing the door locking mechanism.
Figure 5:
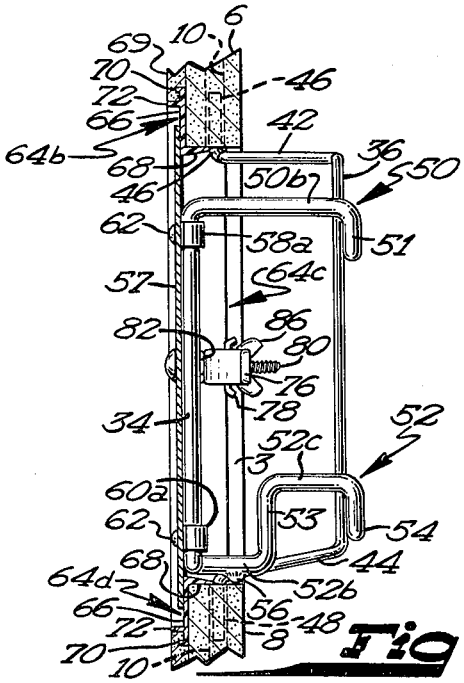
FIG. 5 is a side, elevation view of the door assembly taken along lines 5—5 of FIG. 1.

Referring now to the drawings, I have shown in FIGS. 1, 2 and 5 the preferred embodiment of the improved silo door structure of this invention. It is to be understood that a plurality of door structures such as those illustrated are normally utilized in vertical alignment with each other to provide a series of vertically spaced door openings in a silo wall for access and unloading purposes. See, for example, U.S. Pat. No. 3,709,345.

Figure 6:
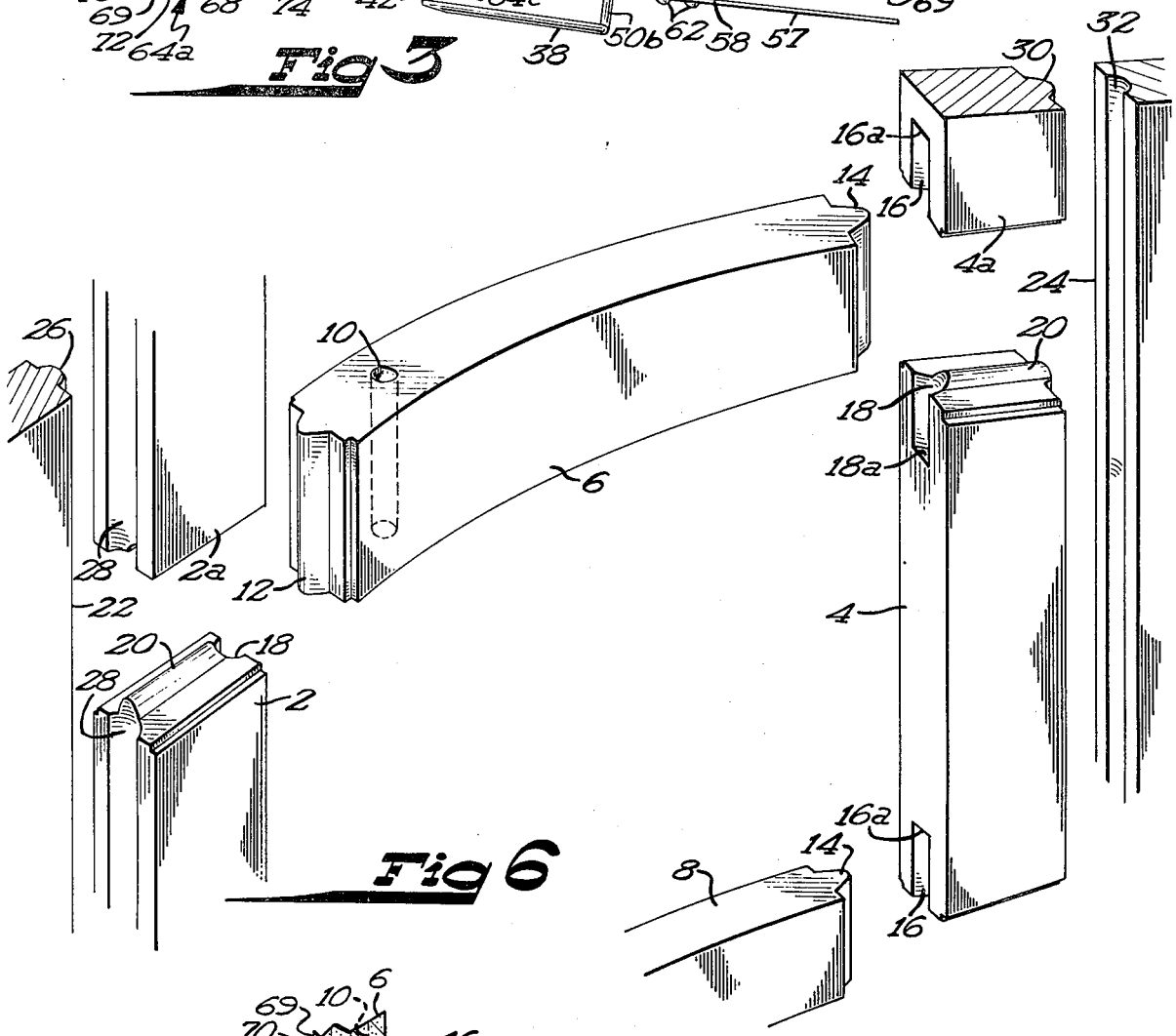
FIG. 6 is an exploded, perspective view of the door frame structure.

The frame for the door structure is preferably comprised of a pair of laterally spaced, vertical members 2 and 4, and a pair of vertically spaced, top and bottom sill beams 6 and 8. These members are arranged and interconnected in the manner shown so as to provide a substantially rectangular door opening. Although the door frame members could be formed and interconnected in various ways, I have found that a particularly solid and easily assembled door frame structure can be provided by the use of the frame arrangement shown most clearly in FIG. 6. Each of the door frame members is preferably a concrete stave made out of the same material as the stave members from which the complete silo is formed. For reasons hereinafter explained, each of the sill or cross beams 6 and 8 has a vertically extending aperture 10 extending therethrough. These apertures serve as a hinge connection for the door assembly in the manner set forth below. It is to be noted that each of the sill beams 6 and 8 is of arcuate shape conforming to the arcuate form of the entire silo wall, as viewed from the interior in FIG. 6. This insures that there will be no straight members associated with the door frame assembly, which would interrupt the arcuate continuity of the silo structure, and possibly interfere with the rotating unloader mechanism operating inside the silo, in contact with the silo wall, in a well known manner. Sill beams 6 and 8 are provided with vertically extending tongues 12 and 14 on their opposite ends. These tongues mate in aligned, vertically extending recesses or slots 16 and 18 formed in the abutting ends of vertical door frame members 4, 4*a*, 4*b* and 2, 2*a* and 2*b* as shown in FIGS. 1 and 6. Sill beams 6 and 8 are supported and properly located by engagement with stop shoulders 16*a* and 18*a* on the ends of slots 16 and 18. These slots are vertically aligned to receive tongues 12 and 14 on the ends of sill beams 6 and 8. With adjacent vertical members 4, 4*a* and 4*b* and 2, 2*a* and 2*b* abutting against each other in the manner shown in FIG. 1, sill beams 6 and 8 will vertically overlap the adjoining ends of these vertical frame members. Thus, there are really only three separate pieces consisting of two vertically extending door frame members and one cross member 6 or 8 which are utilized to form a plurality of vertically aligned door frame openings. The top surface of each of the top sill beams 6 projects above the top ends of each of the vertical frame members 2 and 4 in interlocking engagement with the slots 16 on the bottom of adjoining frame members 2*a* and 4*a*. In this manner, each of the cross beams 6 serves as the top cross beam of one door frame assembly, and as the bottom, sill beam of an adjacent door opening thereabove. In like manner, each of the bottom sill beams 8 as shown in FIG. 1 serves a similar dual function. Vertical frame members 2 and 4 are secured in interlocking engagement with adjoining frame members 2*a* and 4*a* on top thereof by means of tongues 20 formed on the top of members 2 and 4 which are received in through slots 16 on the bottom of adjoining frame members 2*a* and 4*a*. In this manner, a plurality of vertical frame members such as 2, 2*a* and 2*b* and 4, 4*a* and 4*b* can be supported one on top of the other in interlocking engagement to form a continuous door frame extending over the height of a silo wall. Silo wall staves such as those illustrated at 22 and 24 on either side of the door frame structure are secured thereto by interlocking ribs and grooves. Vertical ribs 26 formed on the inside edge of adjoining wall staves 22 are received in mating grooves 28 formed in the outside edge of door frame members 2, 2*a* and 2*b*; and, ribs 30 formed on the outside edge of vertical frame members 4, 4*a* and 4*b* are interlocked within mating grooves 32 formed on adjoining wall staves 24. As is well known in the silo art, an upright shoot, not shown, will normally overly the vertically extending door frame structure in contact with the outside face of the adjoining silo wall members 22 and 24. Such a shoot serves as an access and ensilage unloading passage.

A ladder rung and door hinge assembly is utilized to support a door in closing relation over the openings defined by each of the door frame members and sill beams 2, 4, 6 and 8. This assembly is comprised of a pair of laterally spaced, upright bars 34 and 36, and a pair of vertically spaced, generally horizontal ladder rungs 38 and 40 extending therebetween. One of the upright bars 36 has offset bar segments 42 and 44 extending generally horizontally from its top and bottom ends. These bar segments terminate at their outer ends at a pair of hinge pin extensions 46 and 48 projecting vertically upwardly and downwardly therefrom. Hinge pins 46 and 48 are pivotally received within apertures 10 of cross or sill beams 6 and 8. To this end, apertures 10 extend vertically all of the way through top and bottom sill beams 6 and 8 so as to receive the hinge pin extensions of ladder rung assemblies for door structures above and below each of the cross beams 6 and 8. The bottom offset bar segment 44 is positioned immediately above bottom door sill beam 8 of the door assembly shown in FIG. 1, so as to have at least a portion thereof in contact with the top surface of sill beam 8 when the ladder rung assembly is pivoted to the door closing position shown in FIGS. 1 and 2. Preferably, bar segment 44 is inclined as shown so that only its outer end will be in contact with bottom sill beam 8. This insures that there will be a minimum of frictional contact between bar segment 44 and the top surface of sill beam 8, and thus a minimum of frictional resistance to the opening and closing of the door assembly as hinge pin extensions 46 and 48 rotate within apertures 10.

On the opposite side of the ladder rung assembly, the other upright bar 34 terminates at its top and bottom ends in a second pair of offset bar segments generally indicated by reference numerals 50 and 52. The top bar segment 50 includes portions 50*a* and 50*b* extending at right angles to each other as shown in FIGS. 1 and 6. A vertical bar section 51 connects the outer end of portion 50*b* with one end of top ladder rung 38. Vertical bar portion 51 serves as a top shoulder to prevent a person's foot from sliding off one end of ladder rung 38. Bottom bar segment 52 is comprised of horizontal bar segments 52*a*, 52*b* and 52*c* interconnected as shown in FIGS. 1 and 6, with portions 52*b* and 52*c* vertically separated by an interconnecting leg 53. At its outer end, bar segment 52*c* joins a vertical bar portion 54 connecting it to bottom ladder rung 40, and serving as a foot stop at one end thereof. Vertical leg 53 of bottom bar segment 52 is utilized to position bar portion 52*b* at a level below portion 52*c* where it will be immediately adjacent to bottom door sill beam 8 in overlying relation thereto. A contact lug or boss 56 is formed on bar segment 52 and projects downwardly therefrom so as to contact a top surface of bottom door sill beam 8 when the ladder rung and door hinge assembly is swung to the door closing position as shown most clearly in FIG. 5.

A door 57 of generally rectangular shape, and made of steel or any other suitable material, is affixed to the aforesaid ladder rung assembly and supported thereon by a pair of mounting clamps 58 and 60. Clamp bolts 62 serve to attach clamps 58 and 60 to door 57. Arcuate, sleeve segments 58*a* and 60*a* on door clamps 58 and 60 embrace upright bar 34 at vertically spaced locations thereon. By virtue of this arrangement, bar 34 serves as an elongated hinge pin on which door 57 is free to pivot to a fully open position as explained below with respect to FIG. 3.

Figure 3:
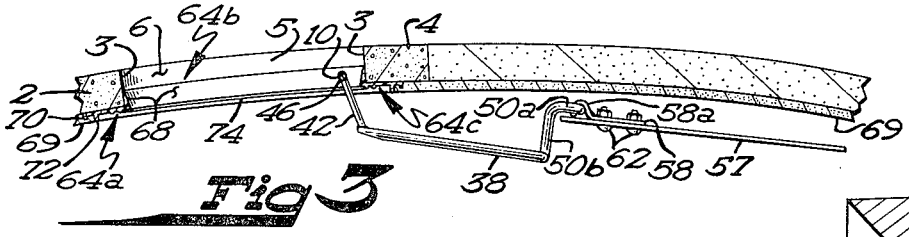
FIG. 3 is a horizontal section view taken along the same lines as FIG. 2 and showing the open positions to which the door may be swung.

By virtue of the aforesaid manner of attaching door 57 to the ladder rung assembly, the ladder rung and hinge pin assembly supports the door, rather than vice versa as is ordinarilly the case. Door 57 may be swung from the fully closed position against the rear or inside face of the aforesaid door frame structure 2, 4, 6 and 8 to an open position as shown in FIG. 3 by swinging movement with the ladder rung assembly acting through pivot pin extensions 46 and 48. When door 57 and the ladder rung assembly is swung to the fully closed position of FIGS. 1, 2 and 5, bottom, generally horizontal bar segments 52*b* and 44 will each have at least a portion thereof in contact with the top face of door sill beam 8. Contact of the ladder rung assembly with door sill 8 is actually accomplished by the outer, downwardly inclined end of bar segment 44, and by lug or boss 56 on bar segment 52*b*. With the ladder rung assembly thus bearing on the top face of sill beam 8 through these contact elements, the entire weight of door 57, and of a person standing on ladder rungs 38 and 40 will be transmitted through upright bars 34 and 36 to sill beam 8, and the door frame structure. Pivot pins 46 and 48 also assist in supporting the door and ladder rung assembly on the door frame through their contact with sill beams 6 and 8. This entire ladder rung and door hinge arrangement for supporting the door 57 ensures that a person standing on ladder rungs 38 or 40 will be supported on the door sill beams 6 and 8, and will not fall, even if door 57 breaks loose from the ladder rung and hinge assembly.

Figure 7:
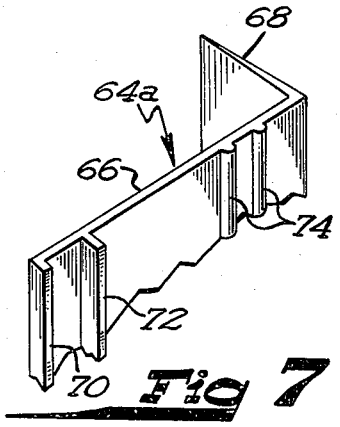
FIG. 7 is a perspective view of the gasket strip for the door frame.

As may be noted by reference to FIGS. 2, 3 and 5, a peripheral edge area of door 57 bears against the rear or inside face of vertical door frame members 2, 4 and sill beams 6 and 8 when the door is swung to its closed position. In order to ensure an airtight, moisture impervious sealing action of door 57 against the door frame structure, a gasket is mounted around the periphery of the door frame in overlying engagement with the rear or inside face of the door frame members 2, 4, 6 and 8 for contact by the peripheral edge area of door 57. The gasket is preferably comprised of a plurality of gasket strips 64*a*, 64*b*, 64*c* and 64*d* extending around the entire door frame along each of the respective door frame segments 2, 4, 6 and 8. These separate gasket strips are cut at 45° angles at their opposite ends so as to abut tightly against each other to form a continuous, peripheral gasket as indicated by the hidden line showing of the gasket strips in FIG. 1. In FIG. 7 there is shown a perspective view of one of the gasket strips 64*a*, each of the strips 64*a*, 64*b*, 64*c* and 64*d* being identical. As shown, each of these strips is comprised of a first, elongated segment 66 which is affixed to the rear or inside face of one of the vertical members or sill beams of the door frame structure, and a flange lip 68 formed integrally therewith, and extending at an angle therefrom. Flange lips 68 of each of the gasket strips abut against the opposite faces of the door frame members and sill beams 2, 4, 6 and 8 extending at right angles to the rear faces thereof, and indicated by reference numerals 3 and 5 respectively. These gasket strips are preferably molded as integral pieces from semi-rigid material such as polyvinylchloride. The strips are formed so that flange lips 68 extend at an included angle of less than 90° from main gasket segments 66. This ensures that flange lips 68 will lie flush against the inside faces 3 and 5 of the door frame after being compressed thereagainst and glued thereto. Each of the gasket strips 64*a*, 64*b*, 64*c* and 64*d* is preferably secured to the rear or inside faces of the vertical members 2, 4 and sill beams 6, 8 by the same plaster lining material 69 which is placed on the entire, inside wall surface of the silo on which the door structure is mounted. Such plaster material is normally applied at a paste or fluid state and is self-hardening on the concrete staves of which the silo is constructed. As may be noted most clearly by reference to FIGS. 2 and 3, each of the gasket strips is provided with a longitudinally extending locking shoulder 70 which projects inwardly from the rear face thereof and is embeded in the plaster lining 69 as the lining is applied. In this manner, shoulders 70 serve to lock and positively hold each of the gasket strips firmly in place against the inside or rear faces of the door frame members 2, 4 and cross beams 6, 8. Each of the gasket strips further includes a second, longitudinally extending shoulder 72 formed thereon in parallel, spaced relation to locking shoulders 70. These shoulder segments 72 serve as stops for the application of the plaster lining material 69 over the gasket strips so as to prevent covering the portion of the gasket strips against which door 57 seats with plaster.

In order to provide tight, weatherproof sealing of door 57 against the gasket strips 64*a* – 64*d*, each of the gasket strips is provided with at least one sealing bead 74 of resilient material extending longitudinally thereon. Although these sealing beads may be formed integrally with the entire gasket strips 64*a* – 64*d* of the same material, I have found it desirable to use a more flexible, resilient material for the sealing beads 74. Two of such sealing beads 74 are shown on each of the gasket strips in the drawings, and are preferably made from a more resilient and flexible composition of polyvinylchloride than that from which the gasket strip segments 66 and 68 are molded. These beads 74 are affixed to gasket strip segments 66 as by gluing. As clearly appears in FIG. 2, when door 57 is swung to its closed position on the ladder rung and door hinge assembly, its peripheral contact area seats against the sealing beads 74 of the gasket strips 64*a* – 64*d* around the entire periphery of the door opening.

For the purpose of providing a very tight closing action of door 57 against the gasket strips and their sealing beads 74, I have provided an improved door closing and locking mechanism shown in FIGS. 1 through 4. This locking mechanism incorporates as its basic components a pivotal locking bar 76 and a clamp arm 78. Both of these members are preferably rotatably mounted on a common, elongated threaded fastener or bolt 80 extending through door 57. A nut 82 bearing against a flat washer 84 is used to secure bolt 80 to door 57, bolt 80 extending through a centrally located hole in door 57. Clamp arm is preferably mounted in overlying relation to locking bar 76 as shown, and is rotatably supported on the shank of bolt 80 by an aperture 88 therein, through which bolt 80 extends. A wing nut 86 on the outer end of bolt 80 serves to hold locking bar 76 and clamp arm 78 in place thereon. Camming means in the form of two inwardly depending lugs 89 and 90 are provided on clamp arm 78 for the purpose of providing inward, pressure engagement of clamp arm 78 against locking bar 76. Contact or camming lugs 89 and 90 protrude as shown from the back or inside face of clamp arm 78 as clearly shown in FIG. 2, and are preferably formed by simply striking these pressure contact lugs or segments from arm 78. Camming lugs 89 and 90 are angularly oriented across clamp arm 78 as shown for reception in an aligned slot 92 formed in the outer face of locking bar 76.

When initially assembling locking bar 76 and clamp arm 78 on bolt 80 on door 57, wing nut 86 is tightened to a hand tight position wherein pressure contact is maintained between clamp arm 78 and locking bar 76 sufficient to hold locking bar 76 securely against the door frame. Locking bar 76 has flattened ends 76*a* which bear against the front or outside faces of upright door frame members 2 and 4 on opposite sides of the door opening when locking bar 76 is rotated to its substantially horizontal locking position as shown in solid lines in FIG. 1. Locking bar 76 is held securely in this position to hold door 57 tightly closed by rotating clamp arm 78 to the horizontal position of alignment therewith as shown in FIG. 1. Gripping end portion 78*a* of clamp arm 78 is utilized for this purpose. In this horizontal, locking position of clamp arm 78, its camming lugs 89 and 90 will be received within elongated slot 92 of locking bar 76, in pressure contact therewith. Camming lugs 89 and 90 exert an inward force on locking bar 76 and thereby press its outer ends 76*a* tightly against the door frame. In order to open the door, handle 78*a* of clamp arm 78 is rotated downwardly in a clockwise direction as indicated by the directional arrow in FIG. 1, to the phantom line, unlocked position shown. This releases camming lugs 88 and 89 from slot 92, and permits locking bar 76 to be rotated in a counterclockwise direction to a position where its opposite, flat ends 76*a* are clear of the opposed, upright members 2 and 4 of the door frame. The entire door assembly is then pushed inwardly into the silo, and swings around pivot pin extensions 46 and 48. As door 57 is being swung inwardly with the ladder rung assembly on pivot pins 46 and 48, it is independently pivoted around upright bar 34 to a fully open position wherein its end 57*a* bears against the outside face of bar segments 50*a* and 52*a* of the ladder rung assembly. This fully open position of door 57 is shown in phantom lines in FIG. 3. In this manner, upright bar 34 serves as a pivot rod about which the arcuate ends 58*a* and 60*a* of door clamps 58 and 60 are free to rotate. When swung to its fully open position as shown in FIG. 3, door 57 will be disposed in a completely non-obstructing position to one side of the door opening wherein it will not interfere with the unloading of material through the silo door. In this fully open position of the door, only the hinge pin extensions 46 and 48 of the entire ladder rung and door assembly will be visible from the outside of the door frame. The door is closed simply by pulling it outwardly, back towards the door frame by gripping locking bar 76. Locking bar 76 is preferably grasped with both hands on opposite ends thereof and turned in a clockwise motion, while pulling out on the bar so that its ends 76*a* rotate past the door frame as they are brought to the horizontal, locking position in engagement therewith as shown in solid lines in FIG. 1. With wing nut 86 finger tight against clamp arm 78, handle 78*a* of clamp arm 78 is rotated upwardly in a counterclockwise direction to the horizontal, locking position shown in solid lines in FIG. 1. As this happens, camming lugs 89 and 90 rotate against locking bar 76 along the bottom of slot 92. This camming action against locking bar 76 forces it tightly against the outer face of the door frame, and in turn pulls door 57 in tightly to a position where its peripheral edge area seats securely against gasket strips 64*a* – 64*d*. With both locking bar 76 and clamp arm 78 rotated to their horizontal, door locking positions, slot 92 will be aligned with the outer extremities of camming lugs 89 and 90 to receive these contact members. In this manner, slot 92 securely holds clamp arm 78 against inadvertent, downward rotation to a position where locking bar 76 might come loose to permit the undesired opening of door 57. For example, without the safety features requiring the manual rotation of clamp arm 78 to release locking bar 76, bar 76 might be accidentally rotated to an open position if a person should step on locking bar 76 rather than on ladder rungs 38 and 40. The combined locking action of locking bar 76 and clamp arm 78 ensures that door 57 will be pulled in very tightly against sealing gaskets 64*a* – 64*d* in the closed position of door 57 to provide an airtight seal.

It is to be noted that when door 57 is swung to its fully open position as shown in FIG. 3, horizontal bar segments 50*a* and 52*a* of the ladder rung assembly serve as stops to limit the swinging movement of door 57 around pivot bar 34 through a 180° arc to its fully open, non-obstructing position. Bar segments 50*a* and 52*a* normally abut against the front face of door 57 when it is in the closed position shown in FIGS. 1 and 2.

I anticipate that various changes can be made in the size, shape and construction of the silo door mounting and sealing structure disclosed herein without departing from the spirit and scope of my invention as defined in the following claims.

What is claimed is:

1. A silo door structure comprising:

a door frame comprising a pair of laterally spaced, vertical members and a pair of vertically spaced, top and bottom sill beams extending therebetween and cooperating therewith to form a door opening;

a vertically extending aperture on one side of each of said sill beams;

a ladder rung and door hinge assembly comprising a pair of laterally spaced, upright bars and a pair of vertically spaced, generally horizontal ladder rungs extending therebetween;

a pair of generally horizontal, offset segments on the top and bottom ends of one of said upright bars, said offset segments terminating at their outer ends in a pair of hinge pin extensions projecting vertically upwardly and downwardly therefrom and pivotally received within said apertures in said sill beams, the bottom one of said offset segments having at least a portion thereof normally resting on the bottom door sill beam, whereby the downward force of a person's weight acting on said ladder rungs will be transmitted through said upright bars to said bottom sill beam;

a door affixed to said ladder rung and door hinge assembly and pivotal therewith on said hinge pin extensions between open and closed positions with respect to said door opening; and means for securing said door and ladder rung assembly in said closed position.

2. A silo door structure as defined in claim 1 wherein:

a second pair of offset bar segments connect the top and bottom ends of the other one of said upright bars with the ends of said ladder rungs opposite said one upright bar, the bottom of one of said second pair of offset bar segments having at least a portion thereof in contact with said bottom door sill beam when said door is in said closed position, whereby the weight of said door is supported on said bottom sill beam through said ladder rung assembly when the door is closed.

3. A silo door structure as defined in claim 1 wherein:

the top surface of said top sill beam projects above the top of both of said vertical door frame members in position to contact the bottom ends of a second pair of vertical door frame members forming a second door frame, whereby said top sill beam may also serve as the bottom sill of an adjacent door opening; and said bottom sill beam projects below the bottom ends of said pair of vertical door frame members in position to engage the top ends of an additional pair of vertical door frame members, whereby said bottom sill beam may serve as the top sill beam of an adjacent door structure; and said vertically extending apertures extend vertically all of the way through said top and bottom sill beams to receive the hinge pin extensions of ladder rung and door hinge assemblies for door structures above and below said silo door structure.

4. A silo door structure as defined in claim 2 wherein:

said bottom one of said second pair of offset bar segments is positioned below the bottom ladder rung of said door structure in overlying relation to said bottom door sill when said door is in said closed position.

5. A silo door structure as defined in claim 2 wherein:

said door is affixed to said ladder rung assembly by vertically spaced clamps embracing the other one of said upright bars at vertically spaced locations thereon, said upright bar serving as the hinge on which the door is free to pivot through a full 180° arc when opened; and each of said second pair of offset bar segments includes a portion thereof normally abutting against the front face of the door when it is closed, and serving as a stop against which the front face of the door along one edge thereof abuts when the door is opened and swung through a 180° arc to an out of the way position adjacent the inside wall surface of a silo on which said door structure is mounted.

6. A silo door structure as defined in claim 1 wherein:

a peripheral edge area of the door bears against the rear face of said vertical members and sill beams of said door frame when said door is in said closed position; and said means for securing said door and ladder rung assembly in said closed position comprises an elongated locking bar swingably mounted on said door and swingable thereon between a door locking position wherein its ends bear against opposite sides of the front face of said door frame and an open position with its ends disengaged from said door frame, and a clamp arm mounted on said door and movable from a disengaged position with respect to said locking bar to a locking position in overlying relation thereto, said clamp arm having camming means thereon bearing against said locking bar in said locking position of said bar and arm to urge said bar tightly against the front face of said door frame and thereby pull the door tightly against the rear face of said door frame.

7. A silo door structure comprising:

a door frame comprised of a pair of laterally spaced, vertical members and a pair of vertically spaced top and bottom sill beams extending therebetween and cooperating therewith to form a door opening;

a ladder rung assembly comprising a pair of laterally spaced, upright bars and a pair of vertically spaced, generally horizontal ladder rungs extending therebetween;

a door affixed to said ladder rung assembly and hingedly mounted therewith on one side of said door frame by vertically extending hinge pin means projecting from said ladder rung assembly for swinging movement between open and closed positions with respect to said door opening, a contact area around the periphery of said door overlying the rear faces of said vertical members and sill beams of said door frame and bearing thereagainst when said door is in said closed position;

an elongated locking bar mounted on said door for swinging movement between a door locking position wherein its opposite ends bear against said laterally spaced, vertical members of said door frame and an open position with its ends disengaged from said door frame; and a clamp arm mounted on said door and movable between a release position with respect to said locking bar and a locking position in restraining engagement therewith, said clamp arm having camming means thereon bearing against said locking bar in said locking position of said bar and arm to urge said bar tightly against the front face of said door frame and thereby pull said door peripheral contact area tightly against the rear face of said door frame.

8. A silo door structure as defined in claim 7 wherein:

said locking bar and said clamp arm are both rotatably mounted on a common, elongated threaded fastener secured to said door, said clamp arm being mounted in overlying relation to said locking bar, and a nut threadably positioned on said fastener, and serving to hold said clamp arm and locking bar on said door, said nut being adjustable to adjust the pressure contact between said clamp arm and said locking bar and between said door and the door frame.

9. A silo door structure as defined in claim 7 wherein:

said clamp arm is rotatably mounted in overlying relation to said locking bar; and said camming means comprises at least one contact lug protruding from the back face of said clamp arm for camming engagement with said locking bar.

10. A silo door structure as defined in claim 9 wherein:

an elongated slot is formed in said locking bar in position to align with said contact lug when both said locking bar and said clamp arm are rotated to said locking position, said slot receiving said lug and thereby securing said clamp arm against disengagement from said locking bar.

11. A silo door structure as defined in claim 10 wherein:

said camming means comprises a pair of contact lugs spaced apart along the length of said clamp arm for locking engagement within said slot in said locking bar when said clamp arm is rotated to said locking position in a position of alignment with said locking bar.

12. A silo door structure as defined in claim 7 wherein:

a sealing gasket extends around the periphery of said door frame in overlying engagement with the rear face of said vertical members and sill beams, and secured thereto by a self-hardening lining material applied to the inside wall surface of a silo on which said door structure is mounted, said peripheral contact area of said door seating against said gasket around said door opening when said door is secured in said closed position.

13. A silo door structure as defined in claim 12 wherein:

said sealing gasket is comprised of a plurality of gasket strips affixed to said vertical members and sill beams of said door frame around said door opening, each of said gasket strips having a locking shoulder extending longitudinally thereof and projecting inwardly from the rear face of said strips, said locking shoulders being embeded in said lining material to hold said gasket strips in place.

14. A silo door structure comprising:

a door frame comprised of a pair of laterally spaced, vertical members and a pair of vertically spaced top and bottom sill beams extending therebetween and cooperating therewith to form a door opening;

a ladder rung assembly comprising a pair of laterally spaced, upright bars and a pair of vertically spaced, generally horizontal ladder rungs extending therebetween;

a door affixed to said ladder rung assembly and hingedly mounted therewith on one side of said door frame by vertically extending hinge pin means projecting from said ladder rung assembly, for swinging movement between open and closed positions with respect to said door opening, a contact area around the periphery of said door overlying the rear faces of said vertical members and sill beams of said door frame and bearing thereagainst when said door is in said closed position;

a sealing gasket extending around the periphery of said door frame in overlying engagement with the rear face of said vertical members and sill beams, and secured thereto by a self-hardening lining material applied to the inside wall surface of a silo on which said door structure is mounted, said peripheral contact area of said door seating against said gasket around said door opening when said door is secured in said closed position;

a fully exposed sealing bead of a resilient material extending longitudinally along each of the strip segments of said gasket overlying said vertical members and sill beams of said door frame and protruding inwardly from said strip segments at a location uncovered by said lining material where said sealing beads will be untouched by said lining material, said peripheral contact area of said door seating against exposed sealing beads when said door is in said closed position; and a locking shoulder extending longitudinally along each of the strip segments of said gasket overlying said vertical members and sill beams of said door frame and projecting inwardly from the rear face thereof, said locking shoulders being imbedded in said lining material to hold said gasket strip segment in place and located farther away from said door frame along said silo wall surface than said sealing beads.

15. A silo door structure as defined in claim 14 wherein:

said gasket comprises a plurality of strips affixed to said vertical members and sill beams of said door frame around said door opening, each of said gasket strips further including a second, elongated shoulder segment extending longitudinally thereon in parallel, spaced relation to said locking shoulder and projecting inwardly from the rear face of said strips between said locking shoulder and said sealing bead on each gasket strip, and serving as a stop for the application of said lining material over said locking shoulders.

16. A silo door structure as defined in claim 14 wherein:

said gasket comprises a plurality of flexible strips affixed to said vertical members and sill beams of said door frame around said door opening, each of said flexible strips having a flange lip angling outwardly therefrom and abutting against the opposite faces of said door frame members and sill beams subjacent to said rear faces thereof.

* * * * *